US005145559A

United States Patent [19]

Auhorn et al.

[11] Patent Number: 5,145,559

[45] Date of Patent: Sep. 8, 1992

[54] PRODUCTION OF PAPER, BOARD AND CARDBOARD

[75] Inventors: Werner Auhorn, Frankenthal; Friedrich Linhart, Heidelberg; Primoz Lorencak, Ludwigshafen; Michael Kroener, Mannheim; Norbert Sendhoff, Gruenstadt; Walter Denzinger, Speyer; Heinrich Hartmann, Limburgerhof, all of Fed. Rep. of Germany

[73] Assignee: BASF Aktiengesellschaft, Ludwigshafen, Fed. Rep. of Germany

[21] Appl. No.: 641,852

[22] Filed: Jan. 16, 1991

[30] Foreign Application Priority Data

Jan. 16, 1990 [DE] Fed. Rep. of Germany ..... 4001045

[51] Int. Cl.[5] ..... D21H 17/45

[52] U.S. Cl. ..... 162/168.2; 162/164.6; 162/168.3; 162/183

[58] Field of Search ..... 162/168.2, 168.3, 190, 162/183

[56] References Cited

U.S. PATENT DOCUMENTS

| | | | |
|---|---|---|---|
| 3,597,314 | 8/1971 | Laube et al. | 162/168.2 |
| 4,421,602 | 12/1983 | Brunnmueller et al. | 162/168.2 |
| 4,774,285 | 9/1988 | Pfohl et al. | 525/60 |

*Primary Examiner*—Peter Chin

*Attorney, Agent, or Firm*—Oblon, Spivak, McClelland, Maier & Neustadt

[57] ABSTRACT

Paper, board and cardboard are produced by draining a paper stock, containing undesirable substances, in the presence of hydrolyzed homo- and/or copolymers of N-vinylformamide having a degree of hydrolysis of not less than 60% and a cationic retention aid. According to the invention, faster drainage and improved retention are obtained compared with the use of known fixing agents.

6 Claims, No Drawings

PRODUCTION OF PAPER, BOARD AND CARDBOARD

European Patent Application 0216387 discloses that copolymers of 95–10 mol % of N-vinylformamide and 5–90 mol % of an ethylenically unsaturated monomer from the group consisting of vinyl acetate, vinyl propionate, the $C_1$–$C_4$-alkyl vinyl ethers, N-vinylpyrrolidone and the esters, nitriles and amides of acrylic acid and methacrylic acid, in partially or completely hydrolyzed form in which 30–100 mol % of the formyl groups have been eliminated from the copolymer, are added to the paper stock prior to sheet formation, in amounts of 0.1–5% by weight, based on dry fibers, as wet and dry strength agents for paper.

U.S. Pat. No. 4,421,602 discloses the use of partially hydrolyzed homopolymers of N-vinylformamide as retention aids, drainage aids and flocculants in papermaking. Since in paper mills the water circulations become more and more concentrated, anionic compounds accumulate in the recycled water and have a very adverse effect on the activity of cationic polymeric process chemicals in the drainage of paper stock and the retention of fillers and fibers. In practice, paper stocks containing undesirable substances are therefore drained using the cationic polymers by a procedure in which drainage of these paper stocks is additionally carried out in the presence of a fixing agent. Examples of fixing agents used are condensates of dicyanodiamide and formaldehyde or condensates of dimethylamine and epichlorohydrin (cf. Tappi Journal, August 1988, pages 131 to 134).

It is an object of the present invention to provide products which are more efficient than the conventional fixing agents and, in combination with cationic retention aids, have an improved retention, flocculation and drainage effect compared with conventional combinations.

We have found that this object is achieved, according to the invention, by a process for the production of paper, board and cardboard by a draining paper stock, containing undesirable substances, in the presence of a fixing agent and a cationic retention aid, if hydrolyzed homo- and/or copolymers of N-vinylformamide having a degree of hydrolysis of not less than 60% are used as the fixing agent.

In the novel process, the paper stocks dewatered are those prepared using all fiber qualities, either alone or as a mixture with one another. The paper stock is prepared in practice using water, which is partially or completely recycled from the paper machine. It is either treated or untreated white water or a mixture of such water qualities. The recycled water contains larger or smaller amounts of undesirable substances which are known to have a very adverse effect on the efficiency of the cationic retention and drainage aids. The content of such undesirable substances in the paper stock can be characterized, for example, by the total chemical oxygen demand (COD). The COD values of such paper stocks are 300–30,000, preferably 1,000–20,000, mg of oxygen/kg of the aqueous phase of the paper stock. These amounts of undesirable substances have a very adverse effect on the efficiency of conventional cationic drainage and retention aids when they are used in papermaking in the absence of fixing agents.

Suitable fibers for the production of the pulps are all conventional grades, for example mechanical pulp, bleached and unbleached chemical pulp and paper stocks obtained from all annuals. Mechanical pulp includes, for example, groundwood, thermomechanical pulp (TMP), chemothermochemical pulp (CTMP), groundwood pulp produced by pressurized grinding, semi-chemical pulp, high-yield chemical pulp and refiner mechanical pulp (RMP). Examples of suitable chemical pulps are sulfate, sulfite and soda pulps. The unbleached chemical pulps, which are also referred to as unbleached kraft pulp, are preferably used. Suitable annuals for the production of paper stocks are, for example, rice, wheat, sugar cane and canef. Pulps are also produced using waste paper, either alone or as a mixture with other fibers.

Pulps of the type described above contain larger or smaller amounts of undesirable substances which, as described above, can be characterized with the aid of the COD or the cationic demand. The cationic demand is that amount of cationic polymer which is required in order to bring a defined amount of the white water to the isoelectric point. Since the cationic demand is very largely responsible for the composition of the particular cationic retention aid used for the determination, a polyamidoamine which was obtained from adipic acid and diethylenetriamine in accordance with Example 3 of German Patent 2,434,816 and had been grafted with ethyleneimine and crosslinked with polyethylene glycol dichlorohydrin ether was used for standardization (cf. polymer I described below). The pulps containing undesirable substances have been abovementioned COD values and a cationic demand of more than 50 mg of polymer I/1 of white water.

According to the invention, the fixing agents used for paper stocks containing undesirable substances are hydrolyzed homo- and/or copolymers of N-vinylformamide having a degree of hydrolysis of not less than 60%. Polymers of this type are disclosed, for example, in European Patent Application 0,216,387. They are prepared by polymerizing, for example, N-vinylformamide and eliminating formyl groups from the polymer by hydrolysis in the presence of acids or bases. Elimination of the formyl group from the polymers containing polymerized N-vinylformamide units lead to the formation of vinylamine units in the polymer. The degree of hydrolysis of the polymerized N-vinylformamide is not less than 60, preferably 70–100, mol %.

The copolymers which are suitable as fixing agents are derived from copolymers which contain, as polymerized units, 95–10 mol % of N-vinylformamide and 5–90 mol % of an ethylenically unsaturated monomer from the group consisting of vinyl acetate, vinyl propionate, the $C_1$–$C_4$-alkyl vinyl ethers, N-vinylpyrrolidone and the esters, nitriles and amides of acrylic acid and methacrylic acid, not less than 60%, preferably from 70 to 100%, of the formyl groups in the copolymer being hydrolyzed and thus being present as amino group. The esters of acrylic acid and methacrylic acid are derived from alcohols of 1 to 6 carbon atoms. Hydrolyzed polymers which are obtainable by polymerizing a) 100–10 mol % of vinylformamide and b) 0–90 mol % of vinyl acetate and/or vinyl propionate and from which, after the polymerization, 60–100% of the formyl groups are eliminated from the polymerized units a) and 60–100% of the acetyl and/or propionyl groups are eliminated from the polymerized units b) of the copolymer are preferably used. Elimination of the formyl groups from the copolymers is preferably effected using hydrochloric acid or sodium hydroxide solution and can be carried out at, for example 20°-100° C.

However, the formyl groups may also be eliminated in the absence of water, using hydrogen chloride or hydrogen bromide. Here, an N-formyl group of the copolymer is converted into an amino group with elimination of carbon monoxide. When acids or bases act on copolymers of N-vinylformamide and acrylonitrile, methyacrylonitrile, N-vinylpyrrolidone and $C_1$-$C_4$-alkyl vinyl ethers, the comonomers of the N-vinylformamide are virtually unchanged chemically whereas the polymerized N-vinylformamide is partially or completely hydrolyzed. In the case of copolymers of N-vinylformamide with vinyl acetate and/or vinyl propionate, for example, the action of hydrochloric acid at 50° C. gives hydrolyzed products in which the polymerized vinyl acetate or vinyl propionate is not hydrolyzed whereas not less than 60% of the polymerized N-vinylformamide is hydrolyzed. If copolymers of N-vinylformamide and vinyl acetate or vinyl propionate are treated with sodium hydroxide solution at 50° C., the formyl groups are eliminated from the polymerized N-vinylformamide and the acetyl or propionyl groups are eliminated from the polymerized vinyl acetate or vinyl propionate, elimination of these groups from the copolymer taking place to roughly the same extents. The degree of hydrolysis of the polymers depends mainly on the amount of acid or base used and on the temperature during hydrolysis.

The homo- and copolymers of N-vinylformamide having a degree of hydrolysis of not less than 60% have Fikentscher K values (measured in 5% strength aqueous sodium chloride solution at a polymer concentration of 0.5% by weight and at 25° C.) of 30–150, preferably 60–90. The fixing agents are used in the novel process in conventional amounts, i.e. 0.02–2, preferably 0.05–0.5%, by weight, based on dry paper stock.

All products commercially available for this purpose can be used as cationic retention aids. These are, for example, polyethyleneimines, polyamines having a molecular weight of more than 50,000, polyamidoamines which may have been modified by grafting of ethyleneimine, and polyether amines, polyvinylimidazoles, polyvinylpyrrolidines, polyvinylimidazolines, polyvinyltetrahydropyridines, polydialkylaminoalkyl vinyl ethers and polydialkylaminoalkyl (meth)acrylates in protonated or quaternized form. Other suitable compounds are, for example, polydiallyldialkylammonium halides, in particular polydiallyldimethylammonium chloride. Particularly preferred retention aids are polyamidoamines obtained from adipic acid and polyalkylenepolyamines, such as diethylenetriamine, which have been grafted with ethyleneimine and crosslinked with polyethylene glycol dichlorohydrin ethers according to German Patent 2,434,816 or epichlorohydrin, and commercial polyethyleneimines and copolymers of acrylamide or methacrylamide and dialkylaminoethyl acrylates or methacrylates, for example copolymers of acrylamide and N,N-dimethylaminoethyl acrylate or copolymers of acrylamide and N,N-diethylaminoethyl acrylate. Basic acrylates are preferably present in acid-neutralized or quaternized form. Quaternization may be effected, for example, using methyl chloride or dimethyl sulfate. The cationic retention aids have Fikentscher K values (determined in 5% strength aqueous sodium chloride solution at a polymer concentration of 0.5% by weight and at 25° C.) of not less than 180.

According to the invention, drainage of the paper stocks containing undesirable substances is carried out in the presence of hydrolyzed N-vinylformamide polymers as fixing agents and the conventionally used cationic retention aids. Preferably, the fixing agent is first added to the paper stock, followed by the retention aid. However, they may also be added simultaneously to the paper stock. All that is important is that drainage of the paper stock takes place in the presence of the fixing agent and the retention aid. The retention aids are used in an amount of from 0.01 to 0.2% by weight, based on dry paper stock. The ratio of fixing agent to retention aid is in general from 1:2 to 5:1. Compared with conventional combinations of fixing agents and cationic retention aids, improved retention and accelerated drainage of the paper stock are achieved in the novel process.

In the Examples which follow, parts and percentages are by weight.

Determination of the drainage time:

1 liter of the fiber suspension to be tested was drained in a Schopper-Riegler tester. The time in which 700 ml of water ran out of the Schopper-Riegler tester was stated as the drainage time.

The chemical oxygen demand (COD) was determined according to DIN 38409.

The light transmittance of the white water was measured using a Zeiss PM 7 spectrophotometer. It is a measure of the retention of crill and fillers and is stated in percent. The higher the value of the light transmittance, the better is the retention.

Cationic demand:

This is the amount of polymer I required to bring one liter of white water to the isoelectric point. The endpoint determination was carried out with the aid of the polyelectrolyte titration according to D. Horn, Progr. Colloid & Polym. Sci. 65 (1978), 251–264.

The K value of the polymers was measured according to H. Fikentscher, Cellulose-Chemie 13 (1932), 48–64 and 71–74, in 5% strength aqueous sodium chloride solution at 25° C. and at a polymer concentration of 0.5% by weight. $K=k.10^3$.

Cationic retention aids used

Polymer 1: Polyamidoamine obtained from adipic acid and diethylenetriamine, which was grafter with ethyleneimine and crosslinked with polyethylene glycol dichlorohydrin ether, according to Example 3 of German Patent 2,434,816.

Polymer 2: Polyamidoamine obtained from adipic acid and diethylenetriamine, which was grafted with ethyleneimine and crosslinked with epichlorohydrin.

Polymer 3: Commercial high molecular weight polyethyleneimine which had been brought to a pH of 7.5 with formic acid.

Polymer 4: Copolymer of 70% of acrylamide and 30% of N-dimethylaminoethyl acrylate in the form of the methochloride, having a K value of 220.

The following were used as fixing agents:

Polymer A: Hydrolyzed homopolymer of N-vinylformamide having a degree of hydrolysis of 96% and a K value of 75.

Polymer B: Hydrolyzed copolymer of 70% of N-vinylformamide and 30% of vinyl acetate, in which 96% of the formyl groups of the polymerized N-vinylformamide and 68% of the polymerized vinyl acetate groups had been hydrolyzed. The K value of the hydrolyzed copolymer was 75.

Polymer C: Commercial condensate of dicyanodiamide and formaldehyde as a comparison with the prior art.

Polymer D: Commercial homopolymer of diallyldimethylammonium chloride, having a K value of 100, as a comparison.

EXAMPLE 1

Several samples of paper stocks containing undesirable substances were prepared by adding in each case 0.2% of the sodium salt of humic acid, as an undesirable substance, to one liter of a wood-containing and kaolin-containing newspaper stock having a consistency of 2 g/l, a pH of 7 and a freeness of 68° SR. (Schopper-Riegler). The amounts, stated in Table 1, of polymer A or polymer C were then metered into the said paper stock, after which 0.06% of the retention aids stated in Table 1 were added and the drainage time was determined. The results obtained are likewise shown in Table 1.

TABLE 1

| | Drainage time [sec] Fixing agent in amounts of | | | |
|---|---|---|---|---|
| | Polymer A | | Polymer C (comparison) | |
| Retention aid | 0.2% | 0.4% | 0.2% | 0.4% |
| Polymer 1 | 52 | 38 | 70 | 66 |
| Polymer 2 | 44 | 34 | 77 | 63 |
| Polymer 3 | 51 | 33 | 86 | 65 |
| Polymer 4 | 21 | 20 | 30 | 27 |

EXAMPLE 2

A wood-containing and kaolin-containing newspaper stock having a consistency of 2 g/l, a pH of 7 and a freeness of 68° SR. was used as the model stock. The paper stock also contained 3of sodium ligninsulfonate as an undesirable substance. The amounts, stated in Table 2, of fixing agent were added to samples of this paper stock, followed by 0.06% of polymer 1 as a cationic retention aid. The drainage time was first determined in a Schopper-Riegler tester, and the light transmission of the resulting filtrate was measured. Furthermore, sheets having a basis weight of 70 g/m$^2$ were formed on the Rapid-Köthen apparatus and their ash content was determined. The amounts used in each case and the results obtained are shown in Table 2.

TABLE 2

| | Drainage time [sec] | | Light transmittance | | Ash [%] | |
|---|---|---|---|---|---|---|
| | 0.2% | 0.4% | 0.2% | 0.4% | 0.2% | 0.4% |
| Polymer A (according to the invention) | 112 | 110 | 18.4 | 27.0 | 11.1 | 13.8 |
| Polymer D (comparison) | 114 | 113 | 16.3 | 22.8 | 10.6 | 12.0 |
| without fixing agent | 116 | | 15.8 | | 11.6 | |

EXAMPLE 3

A paper stock having a consistency of 5 g/l, obtained from 75% of groundwood, 25% of pine sulfate pulp and 35% of china clay and having a freeness of 25° SR and a pH of 7 was processed to paper having a basis weight of 60 g/m$^2$ on an experimental paper machine at a machine speed of 80 m/minute. The paper stock contained 0.2% of the sodium salt of humic acid as an undesirable substance and 0.2% of polymer 1 as a retention aid. Under these conditions, the drainage time was 14 sec and the ash retention 57.4%. In further experiments, the polymers stated in Table 3 were added to the paper stock described above. The results obtained in each case are shown in Table 3.

TABLE 3

| | Drainage time [sec] | Ash [%] |
|---|---|---|
| Without | 124 | 57.4 |
| Polymer 1 (comparison) | 81 | 71.1 |
| Polymer C (comparison) | 45 | 75.3 |
| Polymer A | 12 | 88.4 |

EXAMPLE 4

The model substance used as a wood-containing and kaolin-containing newspaper stock having a consistency of 2 g/l, a pH of 7 and a freeness of 68° SR. 3% of sodium ligninsulfonate were added to the said stock, as an undesirable substance. The paper stock thus obtained was drained in a Schopper-Riegler apparatus. The results obtained without the addition of a retention aid and drainage aid are shown in table 4, as are the results obtained by the addition in each case of 0.2% of the polymers stated in the table, as fixing agents, and a subsequent addition of 0.06% of polymer 1 as a retention aid.

TABLE 4

| | COD (mg $O_2$/l) | Cationic demand (meq/l) of polymer 1 |
|---|---|---|
| Without | 1386 | 1750 |
| Polymer 1 (comparison) | 1408 | 1400 |
| Polymer A | 1222 | 1270 |
| Polymer B | 1301 | 1220 |

We claim:

1. A process for the production of paper, board and cardboard, comprising draining a paper stock containing undesirable substances in the presence of both a fixing agent and a polymeric cationic retention aid other than said fixing agent, wherein said fixing agent is a hydrolyzed homo- and/or copolymer of N-vinylformamide having a degree of hydrolysis of not less than 60%, said fixing agent being present in an amount of 0.02–2% by weight, based on dry paper stock, and said polymeric cationic retention aid being present in an amount of 0.01–0.2% by weight, based on dry paper stock.

2. A process as claimed in claim 1, wherein a hydrolyzed homopolymer of N-vinylformamide having a degree of hydrolysis of from 70 to 100% is used as the fixing agent.

3. A process as claimed in claim 1, wherein a hydrolyzed copolymer of N-vinylformamide which contains, as polymerized units, not more than 90 mol % of ethylenically unsaturated monomers from the group consisting of vinyl acetate, vinyl propionate, the $C_1$–$C_4$-alkyl vinyl ethers, N-vinylpyrrolidone and the esters, nitriles and amides of acrylic acid and methacrylic acid, and in which the degree of hydrolysis of the polymerized N-vinylformamide units is from 70 to 100%, is used as the fixing agent.

4. A process as claimed in claim 1, which comprises using a hydrolyzed polymer which is obtainable by polymerizing a) from 100 to 10 mol % of N-vinylformamide and b) from 0 to 90 mol % of vinyl acetate and/or vinyl propionate and then eliminating from 60 to 100% of the formyl groups from the polymerized units a) and from 60 to 100% of the acetyl and/or propionyl groups from the polymerized units b) of the copolymer as the fixing agent.

5. A process as claimed in claim 1, wherein the polymer used as fixing agent has a K valve of from 30 to 150 (determined according to H. Fikentscher in 5% strength aqueous sodium chloride solution at 25° C. and a polymer concentration of 0.5% by weight).

6. A process as claimed in claim 5, wherein the polymer used as fixing agent has a K valve of from 60 to 90.

* * * * *